US007186008B2

(12) United States Patent
Patti

(10) Patent No.: US 7,186,008 B2
(45) Date of Patent: Mar. 6, 2007

(54) CEILING LIGHTING FIXTURE ASSEMBLY

(75) Inventor: Anthony G. Patti, Arcadia, CA (US)

(73) Assignee: RSA Lighting, LLC, Van Nuys, CA (US)

( * ) Notice: Subject to any disclaimer, the term of this patent is extended or adjusted under 35 U.S.C. 154(b) by 183 days.

(21) Appl. No.: 10/352,400

(22) Filed: Jan. 28, 2003

(65) Prior Publication Data

US 2003/0161153 A1 Aug. 28, 2003

Related U.S. Application Data

(60) Provisional application No. 60/360,456, filed on Feb. 28, 2002.

(51) Int. Cl.
*F21V 21/00* (2006.01)

(52) U.S. Cl. ..... 362/365; 362/147; 362/275

(58) Field of Classification Search ..... 362/147, 362/275, 289, 364, 365, 366, 372, 428, 429, 362/432

See application file for complete search history.

(56) References Cited

U.S. PATENT DOCUMENTS 2,401,390 A * 6/1946 Unger ..... 362/365
3,697,742 A * 10/1972 Bobrick ..... 362/364
5,291,381 A * 3/1994 Price ..... 362/366
5,373,431 A * 12/1994 Hayman et al. ..... 362/364
5,465,199 A * 11/1995 Bray et al. ..... 362/365
5,562,343 A * 10/1996 Chan et al. ..... 362/365
5,609,408 A * 3/1997 Targetti ..... 362/364

* cited by examiner

*Primary Examiner*—Y. My Quach-Lee
(74) *Attorney, Agent, or Firm*—Kleinberg & Lerner, LLP; Marvin H. Kleinberg; Brad E. Mattes

(57) ABSTRACT

An improved recessed lighting fixture allowing illumination from a lighting unit placed within a cavity of a planar surface, such as a ceiling or wall. The invention facilitates the ability to properly aim illumination because the user can aim the fixture while it is in place and illuminated. The invention is additionally designed to allow the substitution of lamps/light bulbs without requiring re-aiming of the fixture and to be used without modification with ceiling materials of varying thickness. The invention also includes an azimuthal adjustment mechanism wherein the lamp is mounted on a gimbal having a rack and pinion coupling to rotate the gimbal under control of a screw accessible from the exterior of the fixture and a horizontal aiming system.

13 Claims, 10 Drawing Sheets

CEILING LIGHTING FIXTURE ASSEMBLY

This application is a continuation-in-part of a U.S. application filed on Feb. 28, 2002 and having Ser. No. 60/360,456.

BACKGROUND

1. Field of the Invention

The present invention relates generally to lighting fixtures and, more specifically, to an improved in-ceiling lighting fixture.

2. Prior Art

Recessed lighting fixtures are well known in prior art. However, such fixtures have been visually obtrusive in that all or some portion of the fixture falls below the ceiling line and disrupts the plane of the ceiling. Recently, low voltage halogen lights have become more popular because they are brighter and consume less energy. This has led to a need for further improvements in recessed lighting fixture design.

For aesthetic reasons, an in-ceiling light fixture is normally at least partially recessed into the planar surface of the ceiling. An opening is cut into the ceiling to illuminate the area beneath the light fixture. The fixture is generally mounted into the ceiling such that the bottom of the fixture (that part closest to the floor when installed) does not extend beyond the plane of the ceiling. Because the opening in the ceiling does not generally have a finished appearance, a trim or bezel is generally installed in the opening to enhance its appearance and conceal the cut out. Historically, the trim piece has been below the planar surface of the ceiling, visually diminishing the aesthetics of the ceiling. The same situation exists with wall mounted recessed lighting.

Another problem arising from the fixtures of prior art is that they could not accommodate differing thickness in ceiling materials. Ceiling panels are constructed in varying thicknesses and the trim/bezel must accommodate the multiple sizes of the ceiling material that are currently available in the market. Formerly, this required the manufacture and use of multiple sized trim kits and increased the costs of storage, materials and labor in installing recessed lighting.

Additionally, the light within the fixture must be properly aimed to achieve the desired design and aesthetic effect. In prior art fixtures, this is difficult and time-consuming. In prior art fixtures, aiming the light typically requires the user to first turn on the light to see where it is initially aimed, then turn off the light to let it cool down (as is required with halogen lighting), then adjust the aim of the light and then turn it on again to see where it is aimed after the adjustment. The process must be repeated until the light is aimed at the desired location. Thus, in the prior art, lights have been difficult to aim without generally requiring several iterations of aiming and adjusting the light, with a cool-down period between each of the several iterations.

Additionally, light bulbs of prior art fixtures have been difficult to replace without removing at least part of the fixture. Moreover, after such light bulb replacement, the aim of the light is often altered and requires re-adjustment and re-aiming.

Therefore, what is needed is an in-ceiling or recessed lighting fixture that is easy to install and use, permits ready adjustment of the aim of the light, and facilitates light bulb replacement without requiring re-aiming of the light.

BRIEF SUMMARY OF THE INVENTION

According to the present invention, an improved recessed lighting fixture allows aesthetically pleasing illumination when the fixture is placed within a cavity of a planar surface, such as a ceiling or wall. The fixture permits ready adjustment of the aim of the light by allowing the aim of the light to be adjusted while the fixture is in place and the light bulb is on. The aim of the light is controlled by two angles, namely, an azimuthal angle that lies in the horizontal plane and an elevational angle that lies in the vertical plane. The fixture also enables its light bulbs to be replaced without requiring re-aiming of the light. Additionally, the present invention may be used with ceiling materials of varying thickness without the need for a trim kit.

The basic elements of the fixture of the instant invention include: a housing designed to fit onto an inner surface of a ceiling or wall, a fixed mudding collar attached to the housing, an adjustable mudding ring that mates with the fixed mudding collar, and a trim unit mounted in the adjustable mudding ring. The trim unit comprises two versions, a round trim unit and a square trim unit, each of which comprises: means to retain the trim unit in the adjustable mudding ring, an elevational light aiming mechanism that controls the elevational angle of the light, a lamp support system attached to the elevational light aiming mechanism, and an opening through which light from the light bulb emanates and through which the elevational angle of the light can be adjusted with a screwdriver.

In the square trim unit, the azimuthal angle of the light is controlled by an azimuthal adjustment ring that resides in the square trim unit. In the round trim unit, the azimuthal angle of the light is controlled by a keyed azimuthal adjustment ring that resides in the housing. Both the square and round trim units have a setscrew that holds the adjustment ring in place after the adjustment ring has been rotated to the desired position.

Unlike prior art, the current invention contains means to adjust the elevational angle of the light while the light bulb is on, without the need to turn the light bulb off and to allow it to cool down. Additionally, the removability of the trim unit and the manner in which the trim unit is made removable allow rapid changing of the light bulb without altering the azimuthal or elevational angle settings of the light and without the need to disassemble the housing.

It is therefore an object of the invention to provide a lighting fixture designed to fit into a recessed space, such as in a ceiling. The light that emanates from the fixture must be strong enough to provide adequate illumination, but diffuse enough to prevent glare and avoid being harsh. Thus, the light must be aimable to allow for proper lighting for conditions within the area to be lit. As with any lighting fixture, light bulbs ultimately burn out and require replacement. In a recessed lighting fixture, replacing a burned out light bulb should not require readjusting the aim of the light.

It is a further object of the present invention to provide a recessed lighting fixture whose light can be easily aimed.

It is a further object of the present invention to incorporate a fixed mudding collar that mates with an adjustable mudding ring in such a way that the housing can be mounted onto surfaces having different thicknesses.

It is a further object of the present invention to provide a light fixture having a light that can be readily and repeatedly aimed with respect to azimuth and elevation.

It is a further object of the present invention to provide a method to quickly replace a light bulb without changing the aim of the light bulb.

Further features and advantages of the present invention will be appreciated by reviewing the following drawings and detailed description.

BRIEF DESCRIPTION OF THE DRAWINGS

For a further understanding of the objects and advantages of the present invention, reference should be made to the following detailed description, taken in conjunction with the accompanying drawings, in which like parts are given like reference numbers and wherein.

DETAILED DESCRIPTION OF THE INVENTION

In the following description, for the purposes of explanation, specific component arrangements and constructions and other details are set forth in order to provide a more thorough understanding of the present invention. It will be apparent to those skilled in the art that the present invention may be practiced without these specific details. In some instances, well-known manufacturing methods and structures have not been described in detail to avoid unnecessarily obscuring the present invention.

Figure 1:
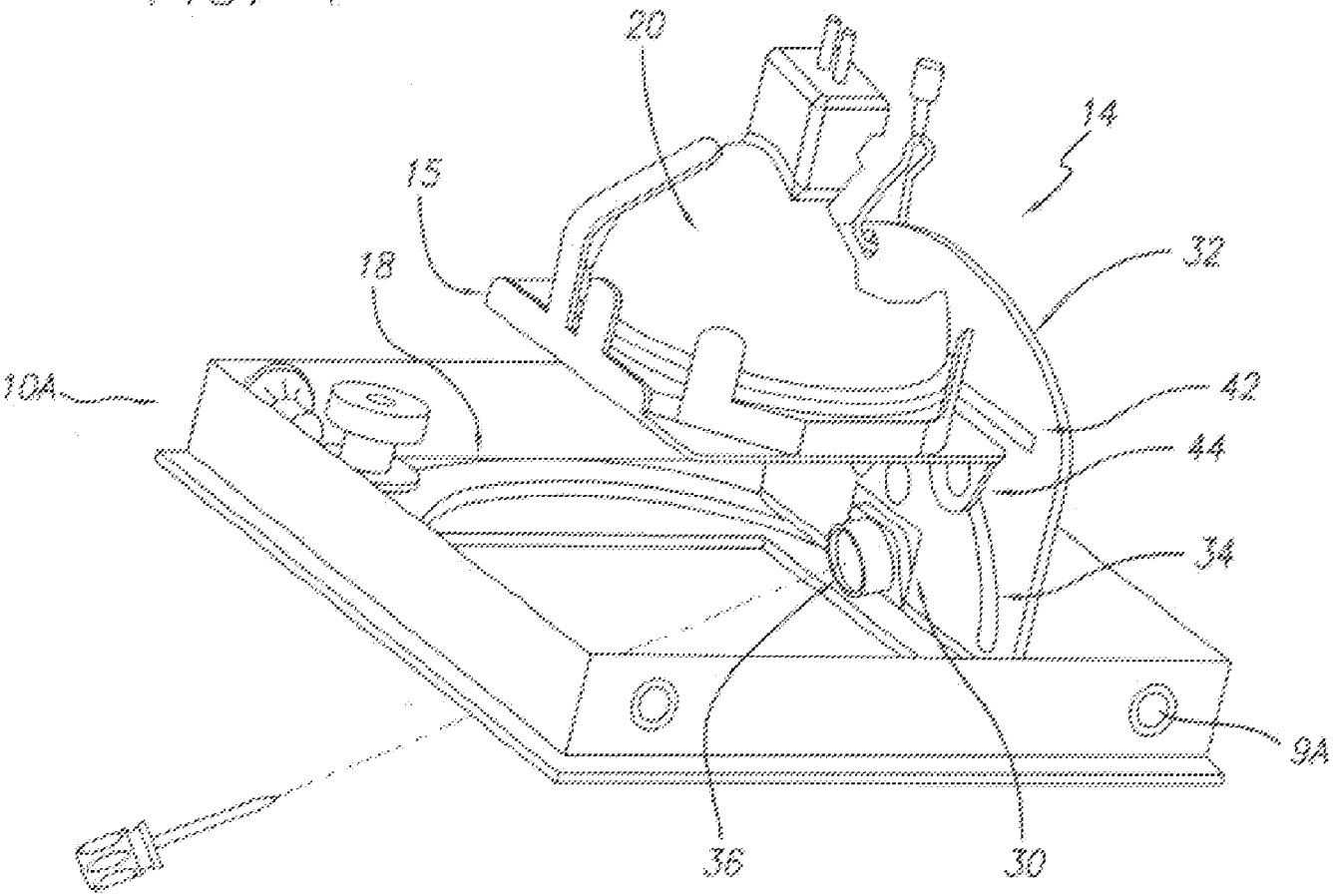
FIG. 1 is a perspective view of a square trim unit.
Figure 2A:
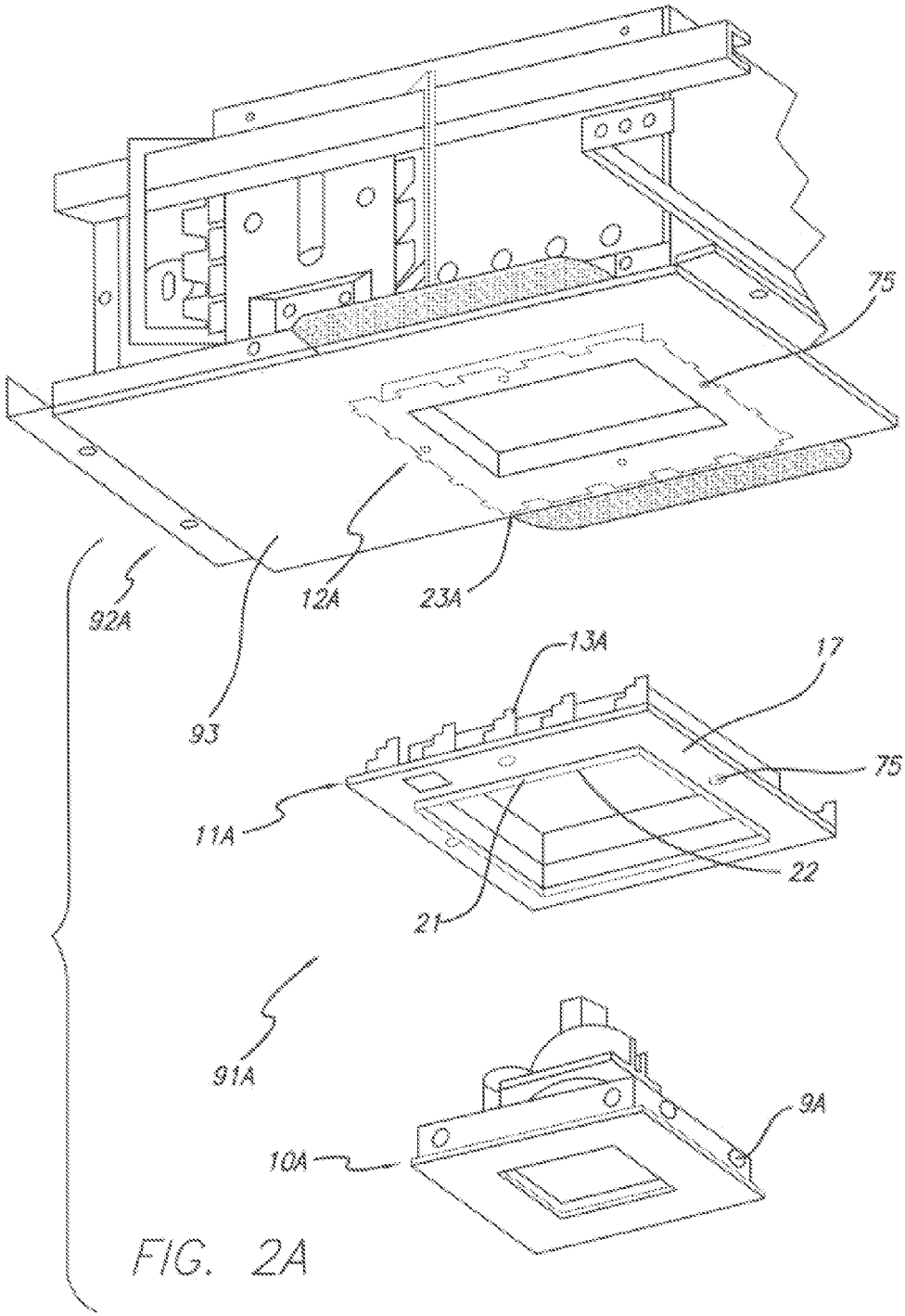
FIGS. 2A and 2B are exploded perspective views showing the housing and fixed mudding collar in relation to the adjustable mudding ring and the trim unit.

Referring first to FIG. 1, a perspective view of a square trim unit 10A of the present invention is shown. FIG. 2A is an exploded perspective view of the fixture 91A for a square trim unit 10A showing its square fixed mudding collar 12A, the adjustable square mudding ring 11A, and the square trim unit 10A. Contained within the square trim unit 10A is a lamp support system 14 (FIG. 1)that includes an azimuthal ring 60 (FIGS. 1 and 5), an elevational light aiming mechanism 19 (FIGS. 1, 3, and 5) and a bulb mount 15.

The housing 92A, 92B of the preferred embodiment is designed for installation in a cavity behind a planar surface, such as a wall or ceiling. Installation of the housing 92A, 92B requires an opening in the ceiling or wall on which the housing 92A, 92B will be mounted. The opening will initially have an unfinished appearance. The fixture 91A, 91B has a mounting surface 93 that rests flush upon the inner surface of the ceiling or wall on which the fixture 91A, 91B is being mounted. The fixed mudding collar 12A, 12B extends into the opening in the ceiling or wall so that the adjustable mudding ring 11A, 11B can be attached to it to provide a more finished appearance. The adjustable mudding ring 11A, 11B has steps 13A, 13B that mate with tabs 23A, 23B located on the fixed mudding collar 12A, 12B. The steps 13A, 13B and tabs 23A, 23B are configured so that by rotating the adjustable mudding ring 11A, 11B with respect to the fixed mudding collar 12A, 12B, the fixture 91A, 91B can be adjusted so that it fits surfaces of different thickness.

The adjustable mudding ring 11A, 11B also has a ring surface 17, a mudding edge 21, and a mudding line 22. When the fixture 91A, 91B has been properly installed, the distance between the mounting surface 93 and the mudding line 22 is equal to or approximately equal to the thickness of the ceiling or wall on which the fixture 91A, 91B is being mounted. When the fixture 91A, 91B has been installed in this manner, the mudding edge 21, the ring surface 17, and the adjacent, unfinished edge of the ceiling or wall form a three-sided cavity that can be filled with mudding material and smoothed over so that none of the components of the fixture 91A, 91B extend beyond the ceiling or wall on which it is mounted. In this manner, once the adjustable mudding ring 11A, 11B has been adjusted to fit a particular ceiling or wall thickness, it is fixed in that position with mudding material.

The trim unit 10A, 10B is held in the adjustable mudding ring 11A, 11B by detents 9A, 9B that reside in the trim unit 10A, 10B and mate with the adjustable mudding ring 11A, 11B. This allows the trim unit 10A, 10B to be readily removed from, or installed in, the adjustable mudding ring 11A, 11B by simply using one's hand to pull the trim unit 10A, 10B out of the adjustable mudding ring 11A, 11B or push the trim unit 10A, 10B into the adjustable mudding ring 11A, 11B.

Figure 3:
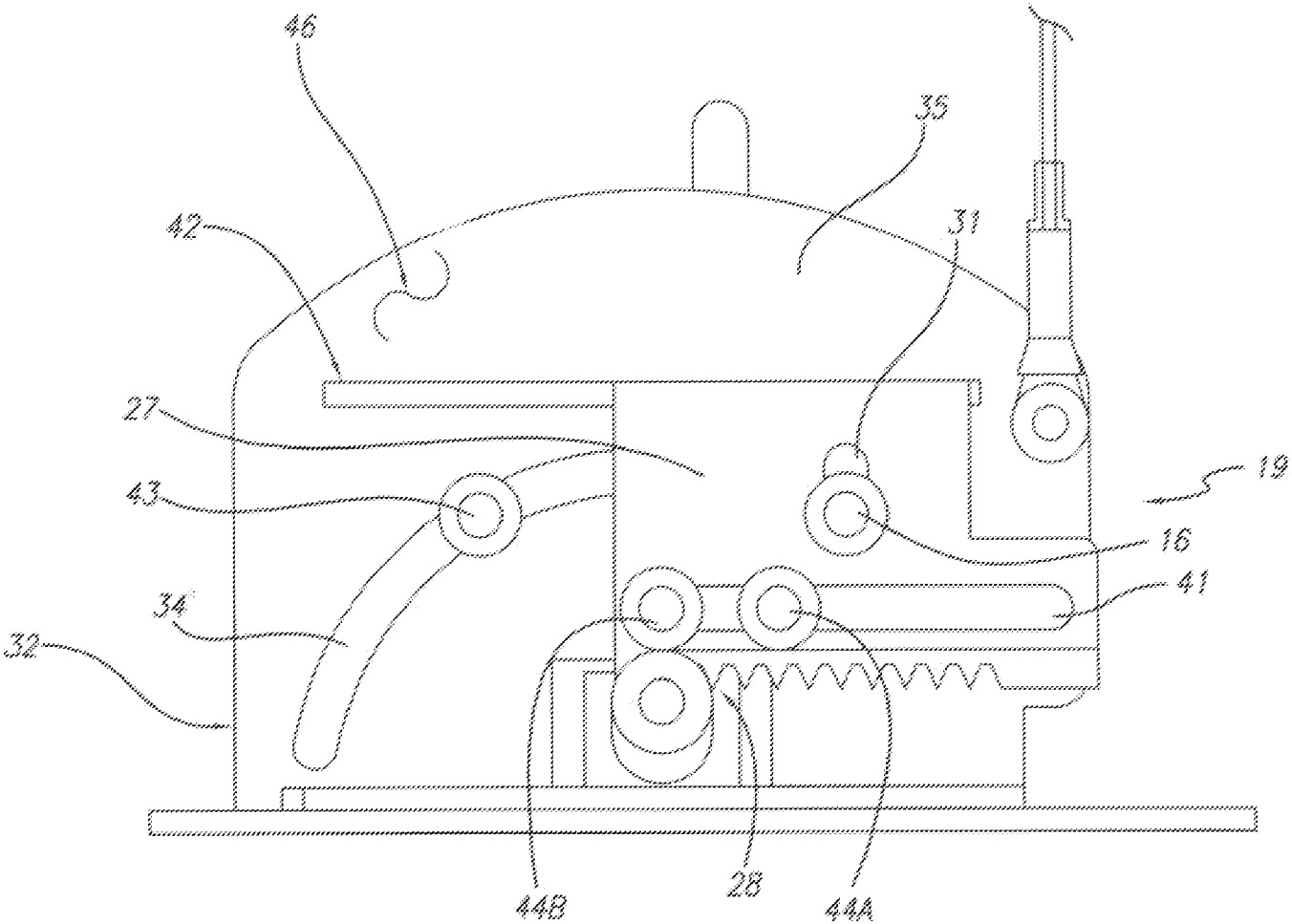
FIG. 3 is a side view of the elevational light aiming mechanism.
Figure 4A:
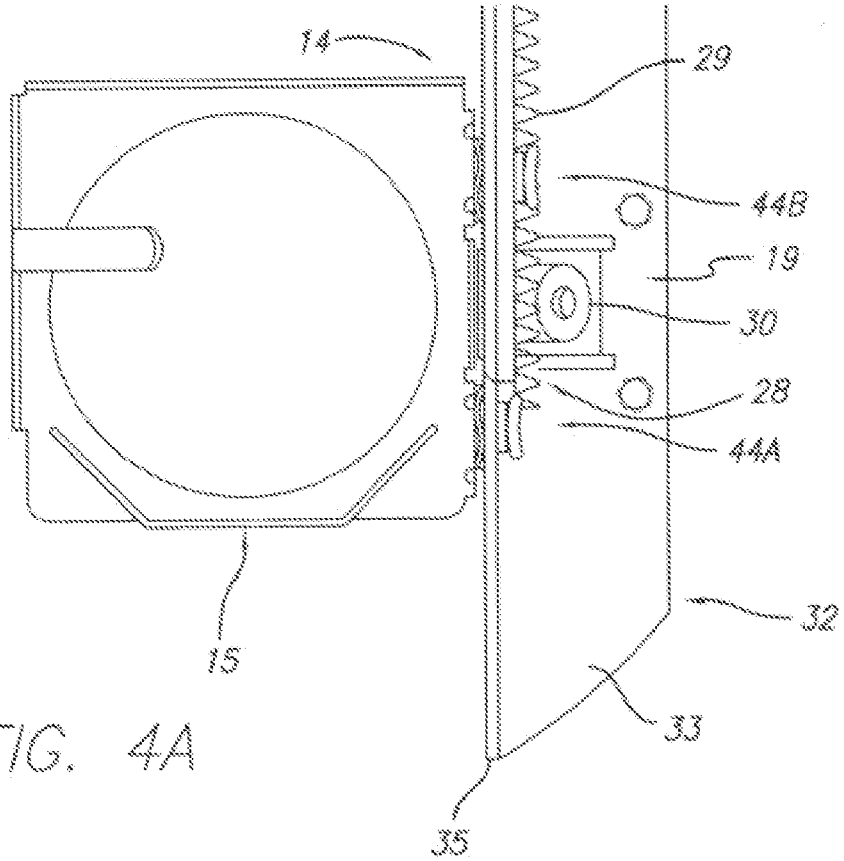
FIG. 4A is a top view of the lamp support system and elevational light aiming mechanism.
Figure 4B:
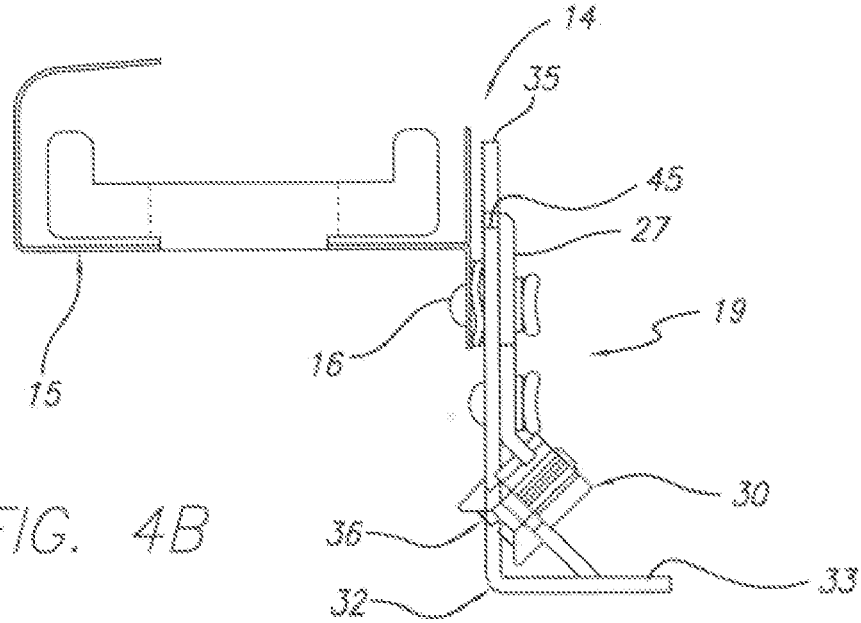
FIG. 4B is a side view of the light bulb holder and elevational light aiming mechanism.

Referring to FIGS. 3, and 4, detailed views of the elevational light aiming mechanism 19 are shown. This elevational light aiming mechanism 19 is the same regardless of whether it is used in the square trim unit 10A or the round trim unit 10B. The elevational angle of illumination is adjustable, even while the light bulb 20 is on and/or hot, by means of a unique rack and pinion assembly 28 and adjustment screw 36 (FIG. 1)

Figure 5:
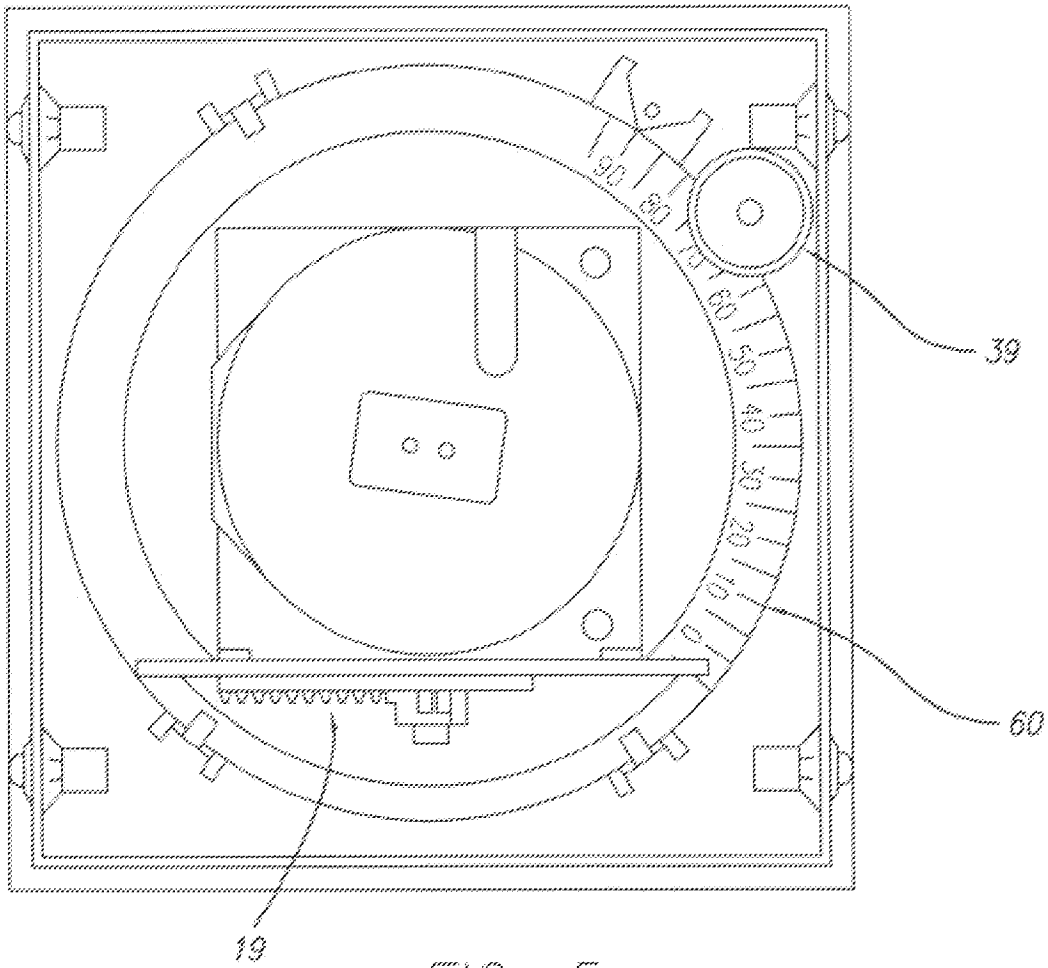
FIG. 5 is a top view of a square version of the trim unit.
Figure 6B:
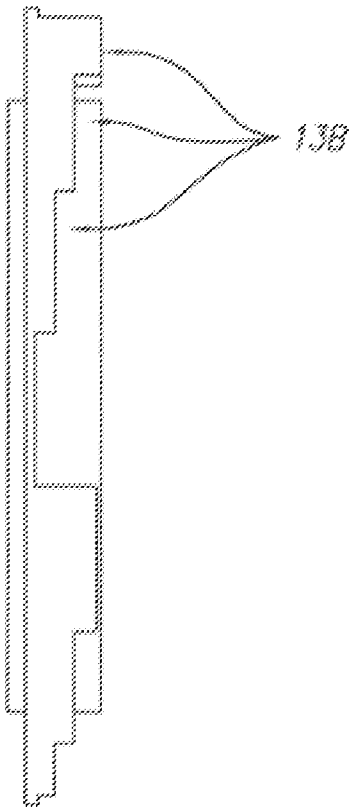
FIGS. 6A and 6B are, respectively, bottom and side views of a round adjustable mudding ring.
Figure 6A:
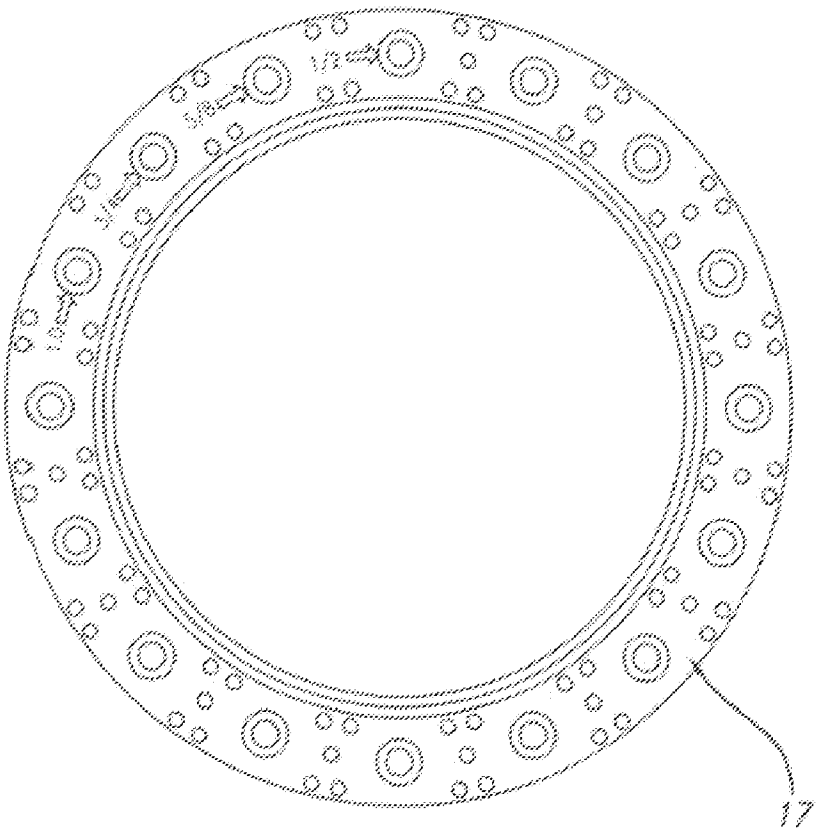
Figure 8B:
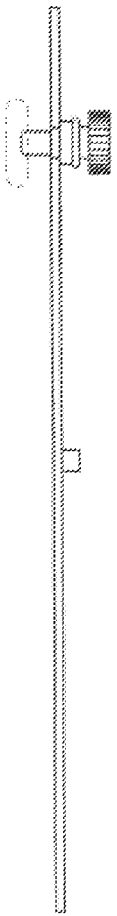
FIGS. 8A and 8B are, respectively, top and side views of the keyed azimuthal adjustment ring.
Figure 8A:
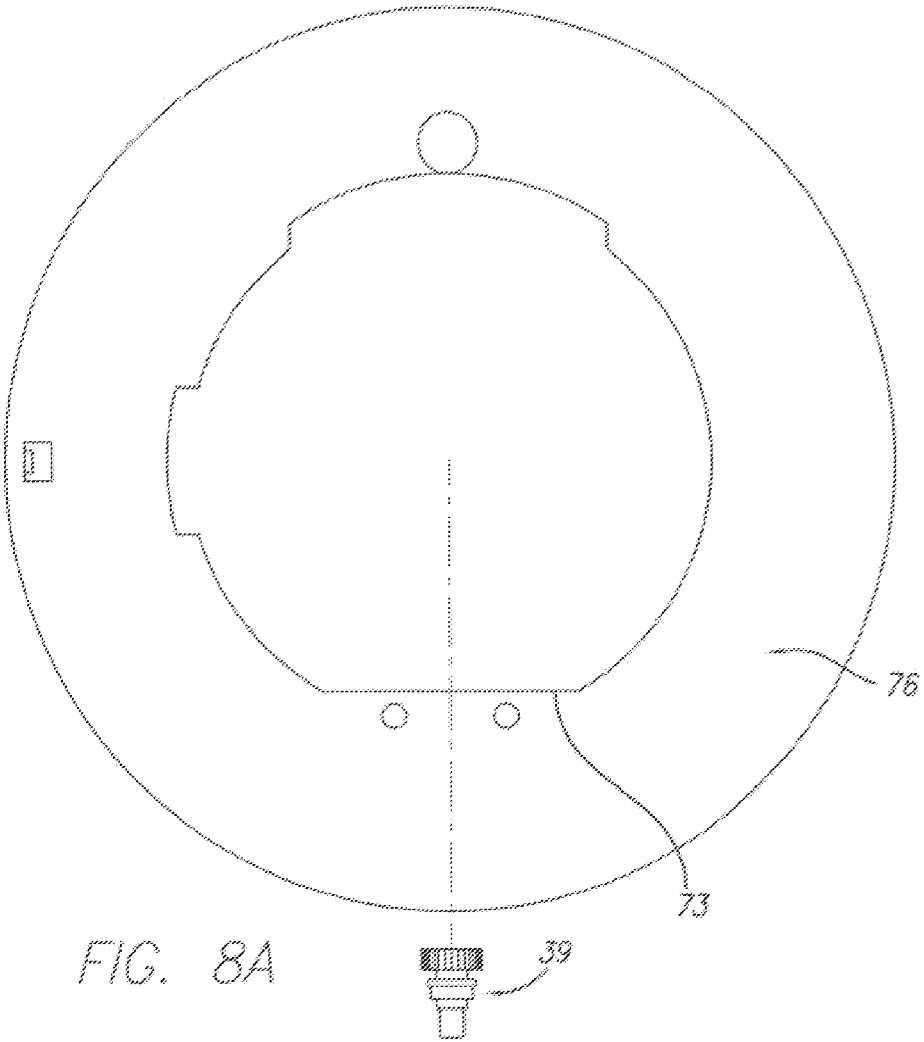
Figure 9:
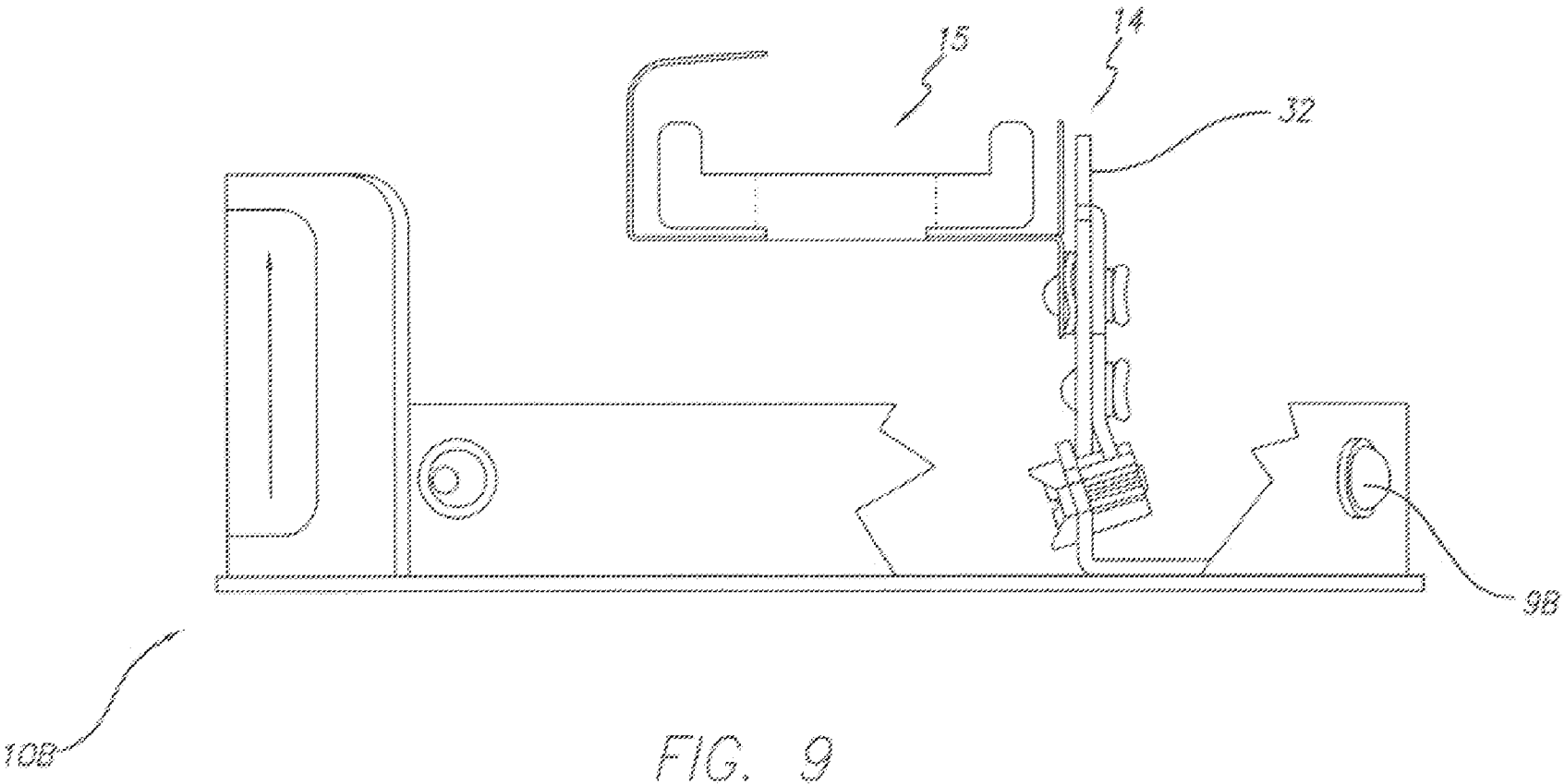
FIG. 9 is a side view of a round trim unit.

FIG. 5 shows how the azimuthal aim of the light bulb 20 in the square trim unit 10A can be adjusted through an arc of 0 to 90 degrees by rotating the circular track 60. FIGS. 8A, 8B, and 9 show the components that control the azimuthal aim of the light in the round trim unit 10B.

The lamp support system 14 includes a bulb mount 15, a bracket 32 a rack and pinion assembly 28, and an adjustment screw 36 (best seen in FIG. 1). The bulb mount 15 further comprises a banana slide rivet 43 and a banana/rack plate rivet 16. The bracket 32 further comprises two rack plate rivets 44A, 44B, a banana slide opening 34, a bracket base 33, a bracket vertical surface 35, and a rectangular opening 42 in the bracket vertical surface 35. The rack and pinion assembly 28 further comprises a rack plate 27, a rack plate lip 45, an elongated bulb mount attachment hole 31 located in the rack plate 27, a rectangular rack plate opening 41, a rack 29, and a pinion gear 30 The bulb mount 15 is attached to the bracket 32 via the banana slide rivet 43 and is further attached to both the bracket 32 and the rack and pinion assembly 28 via a single banana/rack plate rivet 16. Accordingly, when the rack plate 27 moves translationally, the banana slide opening 34 forces the banana slide rivet 43 to move in an arc which, in turn, forces the bulb mount 15 to rotate about its banana/rack plate rivet 16. The elongated nature of the bulb mount attachment hole 31 allows the banana/rack plate rivet 16 to move up or down as needed to accommodate the curvature of the banana slide opening 34. In this manner, even while the light bulb 20 is on and hot, its elevational aim is adjustable via an adjustment screw 36 that turns the pinion gear 30 which causes the rack plate 27 to move translationally. Translational movement of the rack plate is obtained by controlling movement of the rack plate 27 via engagement of the rack plate lip 45 with the rectangular opening 42 and engagement of the rectangular rack plate opening 41 with the rack plate rivets 44A, 44B.

Referring next to FIG. 5, in addition to elevational aiming described above, the azimuthal angle of the light can be adjusted in the square trim unit 10A. This azimuthal adjustment is made by removing the square trim unit 10A from the adjustable mudding ring 11A, loosening the setscrew 39, rotating the azimuthal ring 60 to the desired setting, and then tightening the setscrew 39. At this point, the square trim unit is ready to be re-installed in the adjustable mudding ring 11A. The range of rotation of the azimuthal ring 60 is less than 360 degrees with respect to the square trim unit 10A. However, this limitation is fully addressed by installing the square trim unit 10A in any one of the four principal orientations available based on the four equal sides of a square.

In the round trim unit 10B, the keyed azimuthal adjustment ring 76 controls the azimuthal angle of the light. The keyed azimuthal adjustment ring 76 resides in the housing 92B and can be adjusted by rotating it by hand. To access the keyed azimuthal adjustment ring 76, the round trim unit 10B is removed from the adjustable mudding ring 11B. The setscrew 39 in the keyed azimuthal adjustment ring 76 is then accessible, and can be loosened, by hand. After the setscrew 39 is loosened, the keyed azimuthal adjustment ring 76 can be rotated through 360 degrees while it resides in the housing 92B. A straight edge 73 in the keyed azimuthal adjustment ring 76 acts as a key that allows the round trim unit 10B to be inserted into the keyed azimuthal adjustment ring 76 in only one orientation, namely, in such a way that the bracket vertical surface 35 is aligned with the straight edge 73. In any other orientation, the straight edge 73 would prevent the round trim unit 10B from passing into the keyed azimuthal ring 76 because the bracket vertical surface 35 is relatively straight while the keyed azimuthal ring 76, except for its straight edge 73, is round. In this manner, the straight edge 73 allows the light bulb 20 to be aimed in only one azimuthal direction, namely, in the same azimuthal direction as the straight edge 73. Once this direction has been selected by rotating the keyed azimuthal ring 76, the setscrew 39 is then tightened and the round trim unit 10B is re-installed in the adjustable mudding ring 11B.

Figure 2B:
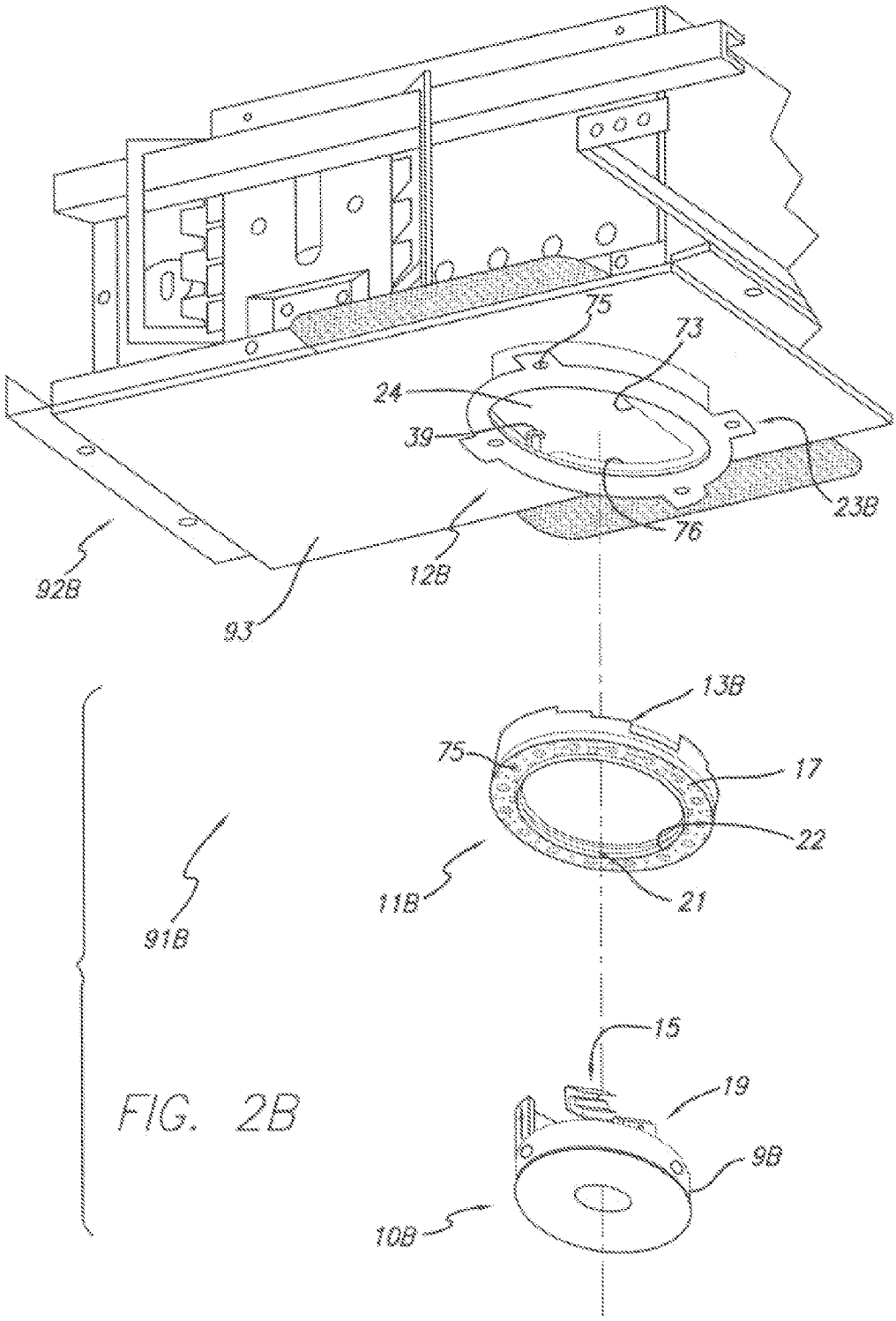

FIGS. 2A and 2B show the steps 13A, 13B of the adjustable mudding ring 11A, 11B that make it adjustable with respect to, and when mated with, the tabs 23A, 23B of the fixed mudding collar 12A, 12B. The steps 13A, 13B in both the square and round version of the adjustable mudding ring 11A, 11B typically have four different heights, each one of which corresponds to one of four nominal thicknesses for ceiling or wall materials. Such nominal thicknesses are typically ½", ⅝", ¾" or 1".

Figure 7:
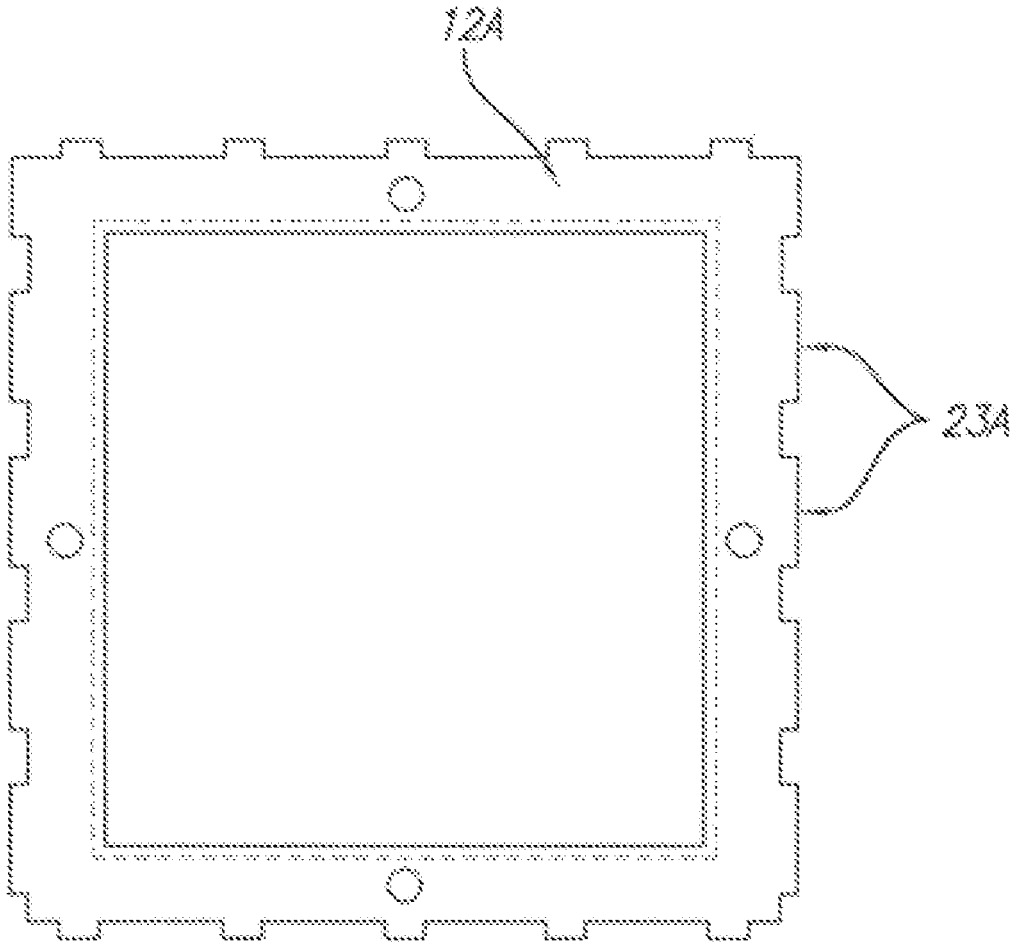
FIG. 7 is a bottom view of a square fixed mudding collar.

The tabs 23A on the square fixed mudding collar 12A are spaced uniformly apart from one another along each side of the fixed mudding collar 12A. However, among the four sides of the square fixed mudding collar 12A, the tabs 23A are spaced differently so that each set of tabs 23A along any one of the four sides corresponds to one of four nominal ceiling or wall thicknesses in which the fixture 91A may be mounted. This different spacing of the tabs 23A among the four sides of the square fixed mudding collar 12A is best seen in FIG. 7. The adjustable mudding ring 11A is rotated to one of four positions so that its steps 13A engage the tabs 23A of the square fixed mudding collar 12A. In this manner, the height of the steps 13A allows the distance between the mounting surface 93 and the ring surface 17 to be adjusted to fit one of four nominal ceiling or wall thicknesses. Once the adjustable mudding ring 11A has been installed on the fixed mudding collar 12A, they can be secured to one another via screws inserted through screw holes 75. After the fixed mudding collar 12A and the adjustable mudding ring 11A have been secured to one another, mudding material is applied to fill the cavity created by the mudding edge 21, the ring surface 17, and the opening in the ceiling or wall in which the fixture 91A is being mounted. This provides a finished look to the installed fixture 91A so that no portion of it extends beyond the outer surface of the ceiling or wall in which it is mounted. Once mudding material has been applied and installation is complete, only the trim unit 10A can be readily installed and/or removed.

The tabs 23B on the round mudding collar 12B are typically spaced uniformly around the round mudding collar 12B. The adjustable mudding ring 11B is rotated to one of four positions so that its steps 13B engage the tabs 23B of the round fixed mudding collar 12B. In this manner, the height of the steps 13B allows the distance between the mounting surface 93 and the ring surface 17 to be adjusted to fit one of four nominal ceiling or wall thicknesses. Once the adjustable mudding ring 11B has been installed on the round fixed mudding collar 12B, they can be secured to one another via screws inserted through screw holes 75. After the round fixed mudding collar 12B and the adjustable mudding ring 11B have been secured to one another, mudding material is applied to fill the cavity created by the mudding edge 21, the ring surface 17, and the opening in the ceiling or wall in which the fixture 91B is being mounted. This provides a finished look to the installed fixture 91B so that no portion of it extends beyond the outer surface of the ceiling or wall in which it is mounted. Once mudding material has been applied and installation is complete, only the trim unit 10B can be readily installed and/or removed.

The description of the present invention has been made with respect to specific arrangements and constructions of a recessed, architectural lighting fixture. It will be apparent to those skilled in the art that the foregoing description is for illustrative purposes only, and that various changes and modifications can be made to the present invention without departing from the overall spirit and scope of the present invention. The full extent of the present invention is defined and limited only by the following claims.

What is claimed is:

1. A recessed lighting fixture comprising:

a housing;

a fixed mudding collar attached to the housing, said mudding collar having means to adjustably engage an adjustable mudding ring;

said adjustable mudding ring having means to adjustably engage the fixed mudding collar; and a trim unit adapted to support a light and further adapted to engage and disengage said adjustable mudding ring.

2. The invention of claim 1 wherein said trim unit further comprises means for adjusting the azimuthal aim of the light.

3. The invention of claim 1 wherein said housing includes an azimuthal adjustment ring for controlling the azimuthal direction of the light.

4. The invention of claim 3 wherein said azimuthal adjustment ring includes a key and a setscrew.

5. The invention of claim 1 wherein said trim unit is round.

6. The invention of claim 1 wherein said trim unit is rectangular.

7. The invention of claim 1 wherein said trim unit is square.

8. The invention of claim 1 wherein said trim unit further comprises means to adjust the elevational aim of said light.

9. A recessed trimless lighting fixture comprising:

a housing;

a fixed mudding collar attached to the housing;

an adjustable mudding ring connectable to the fixed mudding collar wherein the fixed mudding collar and adjustable mudding ring are capable of being adjusted for use with various surface thicknesses; and a trim unit that can be readily removed from or installed in the fixed mudding collar and which further comprises means for supporting a light and means for adjusting the elevational aim of the light while the light is on.

10. A recessed trimless lighting fixture comprising:

a housing;

a fixed mudding collar attached to the housing;

an adjustable mudding ring connectable to the fixed mudding collar; and a trim unit that can be readily removed from or installed in the fixed mudding collar and which further comprises means for supporting a light and means for adjusting the elevational aim of the light while the light is on wherein the means for adjusting the elevational aim of the light comprises a rack and pinion assembly mounted on a bracket having a banana slide opening and a bulb mount that can be aimed using the rack and pinion assembly and the banana slide opening.

11. A recessed lighting fixture comprising:

a housing;

an azimuthal adjustment ring adapted to be installed in said housing, said azimuthal adjustment ring further comprising means to accept a trim unit in only one orientation and means to be locked in place with respect to said orientation.

12. The invention of claim 11 wherein said means to accept a trim unit include a straight edge that cooperates with said trim unit.

13. The invention of claim 11 wherein said means to lock said azimuthal adjustment ring is a setscrew.

* * * * *